US010125933B1

(12) United States Patent
Machlis et al.

(10) Patent No.: US 10,125,933 B1
(45) Date of Patent: Nov. 13, 2018

(54) CURVED RECESSED SUPPORTING DEVICE FOR INSTALLATION OF LED ILLUMINATING DEVICES IN WALLS AND CEILINGS

(71) Applicant: PreciseLED, Inc., Valley Stream, NY (US)

(72) Inventors: Daniel Machlis, Far Rockawway, NY (US); Hao Zheng, Flushing, NY (US); Waqar Iqbal, Hempstead, NY (US)

(73) Assignee: Precise LED, Inc., Valley Stream, NY (US)

( * ) Notice: Subject to any disclaimer, the term of this patent is extended or adjusted under 35 U.S.C. 154(b) by 0 days.

(21) Appl. No.: 15/968,607

(22) Filed: May 1, 2018

Related U.S. Application Data

(60) Provisional application No. 62/503,078, filed on May 8, 2017.

(51) Int. Cl.
*F21S 8/02* (2006.01)
*F21V 21/14* (2006.01)
*F21V 21/04* (2006.01)

(52) U.S. Cl.
CPC ..... *F21S 8/026* (2013.01); *F21V 21/04* (2013.01); *F21V 21/14* (2013.01)

(58) Field of Classification Search
CPC ... F21S 8/024; F21S 8/026; F21S 4/28; F21V 21/04; F21V 21/14
See application file for complete search history.

(56) References Cited

U.S. PATENT DOCUMENTS 7,614,764 B2 * 11/2009 Williams ..... F21V 21/005 362/217.01
2007/0263379 A1 * 11/2007 Dowling ..... F21S 8/024 362/151
2008/0094828 A1 * 4/2008 Shao ..... F21K 9/00 362/219
2015/0009664 A1 * 1/2015 Liang ..... F21K 9/17 362/219
2015/0070882 A1 * 3/2015 Ohno ..... F21K 9/20 362/219
2015/0360271 A1 * 12/2015 Hawkins ..... G01N 21/8803 362/219
2016/0169462 A1 * 6/2016 Hawkins ..... G01N 21/8806 362/219

* cited by examiner

*Primary Examiner* — Thomas M Sember
(74) *Attorney, Agent, or Firm* — Shifrin Patent Law; Dan Shifrin

(57) ABSTRACT

A curved recessed supporting device is provided for installation of LED illuminating devices comprising a curved main channel section, shorter open-top end modules securable to a first end of the channel section, and an elongated lens securable over the top of the channel section. Flanges extending from the bottom of the channel section are secured to a wall stud or ceiling joist and end modules are secured to the ends of the channel section. LED strips are secured onto the spaced apart sidewalls inside the channel section and connected to appropriate wiring through one of the end modules. A channel cap is secured across the top of the end modules and foam inserted into the channel section. Drywall is laid to the edges of the device, is spackled and painted. The foam is removed and the lens secured over the channel section.

17 Claims, 8 Drawing Sheets

CURVED RECESSED SUPPORTING DEVICE FOR INSTALLATION OF LED ILLUMINATING DEVICES IN WALLS AND CEILINGS

RELATED APPLICATION DATA

The present invention is related to and claims the benefit of U.S. Provisional Patent Application No. 62/503,078, entitled CURVED RECESSED SUPPORTING DEVICE FOR INSTALLATION OF LED ILLUMINATING DEVICES IN WALLS AND CEILINGS and filed on May 8, 2017, which application is incorporated by reference in its entirety. The present application is a continuation-in-part of commonly-owned and co-pending PCT Patent Application Serial Number PCT/US16/51557, entitled RECESSED SUPPORTING DEVICE FOR INSTALLATION OF LED ILLUMINATING DEVICES IN WALLS AND CEILINGS, filed on Sep. 13, 2016, which application is incorporated herein by reference in its entirety. The present application is also related to commonly-owned and co-pending U.S. Design application Ser. No. 29/557,865, entitled WALL INSTALLATION SUPPORT FOR LED STRIP LIGHTING, filed on Mar. 14, 2016, and to commonly-owned and co-pending International Design application Ser. No. 35/001,262, entitled WALL INSTALLATION SUPPORT FOR LED STRIP LIGHTING, filed on Sep. 13, 2016, which applications are incorporated herein by reference in their entireties

FIELD OF THE INVENTION

This invention relates to the field of lighting, and more particularly, the field of in-wall installation of LED-based lighting.

BACKGROUND OF THE INVENTION

There are many kinds of linear lighting apparatuses. Many of the most recent ones consist of light emitting diodes (LEDs) as light sources. LEDs are individual light sources, that, when combined on a flexible strip, can give off a linear "line" of light. This line of light is desirable in both offices and homes, in vertical and horizontal installations (and any angle in between).

One limitation that exists in the industry today is the lack of a product that is well-designed for recessed curved flangeless installation, using a remotely installed driver, inside drywall, such as ⅝" thick, which is a common thickness of drywall. One advantage of remotely installing an LED driver is that the driver can easily be changed upon device failure, without the need for removing the entire fixture.

In order for a product to be considered to be "flangeless" by common standards, it has to contain a thin flange, which allows for the installer to stop the spackle before the lens. Without such a flange, the spackle installation will be messy and won't give the light a seamless look.

Most curved fixtures in the marketplace today are surface mounted (meaning immediately below or above the ceiling/wall) or pendant mounted (meaning held beneath the ceiling with aircraft cable or similar hanging apparatus). A recessed curved fixture is difficult to manufacture for several reasons: 1) If driver is integral, which is the case in many recessed linear fixtures) it would be problematic to place the driver in a curved fixture, as the drivers are generally linear and rectangular, and have a few inches in length, something that the curved fixture would need to accommodate for. So the curvature of the fixture would be limited in angles/radius offered. 2) If rigid LED boards are used, the LED boards would have to be customized for each curve separately. 3) The lens would either have to be flexible or custom cut somehow to the particular curve. 4) If the flange described in paragraph above is made from the same extrusion as the fixture, it would need to bend. Something as thin as this flange would be difficult if not impossible to bend in the direction needed to form a curved line of light on the wall; the flange would warp almost immediately during the bending process. 5) Finally, if the product was to be thicker than the thickness of drywall itself, complicated measurements would need to be factored in order to accommodate the fixture within the studs.

SUMMARY OF THE INVENTION

Embodiments of the present invention provide a curved recessed supporting device for installation of LED illuminating devices and a method for installing LED illuminating devices. The device comprises a main channel section, shorter open-top end modules securable to a first and second ends of the main channel section, and an elongated lens securable over the top of the main channel section. The main channel section is bent using common bending methods to meet the curvature required. Clips attached to both sides of the main channel section are secured to a wall stud or ceiling joist and end modules are secured to the ends of the main channel section. LED strips is secured on the sidewalls inside the main channel section and connected to appropriate wiring through one of the end modules. A channel cap is secured across the top of the end modules and foam is temporarily inserted into the main channel section. Drywall is laid to the edges of the device, is spackled and painted. The foam is then removed and the lens secured over the main channel section.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
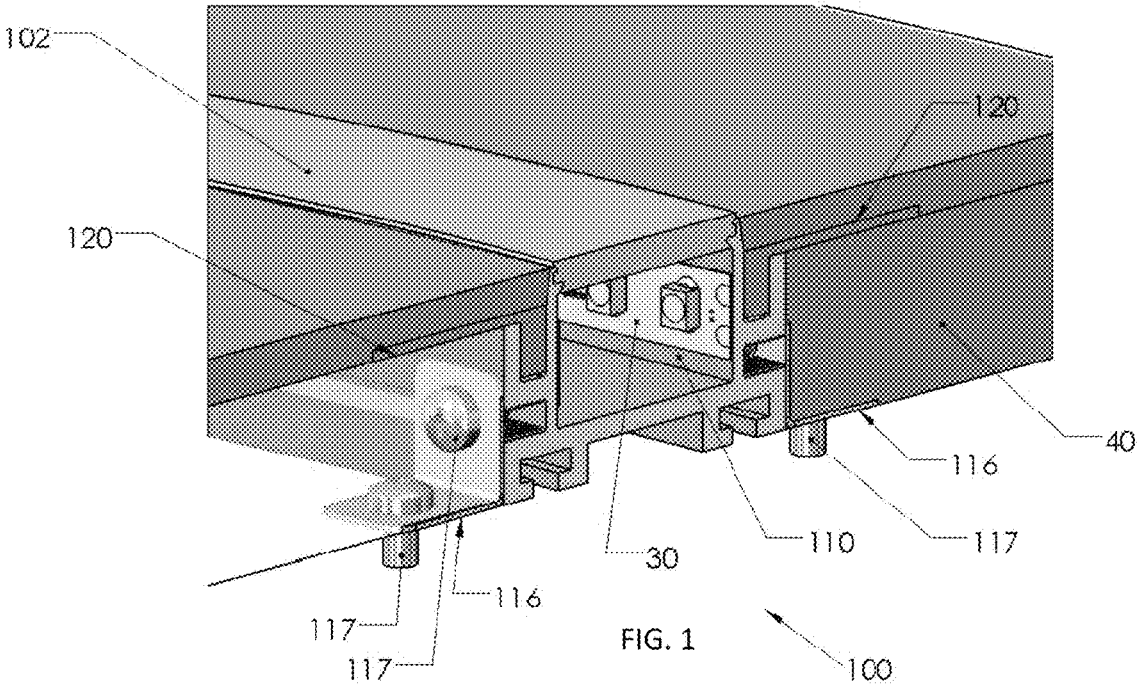
FIG. 1 is a schematic view of an embodiment of an LED strip installation supporting device of the present invention as installed.
Figure 2:
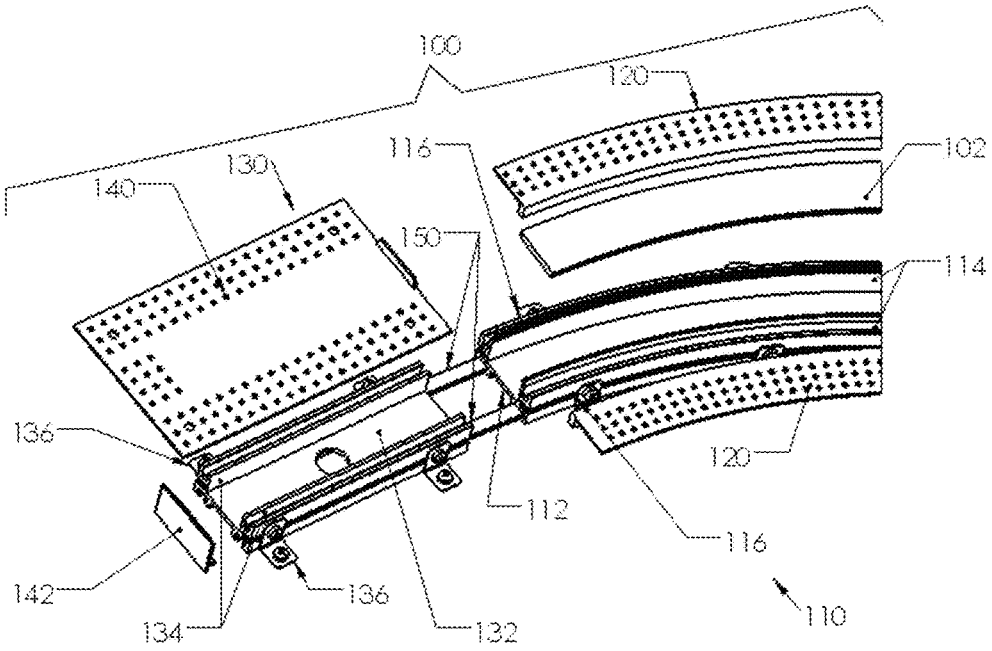
FIG. 2 is an exploded view of an embodiment of the support device of FIG. 1.

Embodiments of the device of the present invention provide a curved recessed apparatus 100 (FIG. 1) which allows for the simple installation of one or more flexible LED strips 30 light in, for example, ⅝" drywall 40, with the lens of the fixture being flush with the surface of the drywall. The device comprises channel 110 formed from, for example, extruded aluminum, a lens 102, flanges 120, and end modules 130 (FIG. 2). The channel 110 acts as a heat sink for the LED strip 30. The lens 102 covers the channel 110 and acts to diffuse the light from the LED strip 30. The flanges 120, made from a material such as polyvinyl chloride (PVC), facilitate installation using spackle along the sides of the channel 110. The end modules 130 are designed to accept a BX or conduit that contains the low-voltage wiring required to power the LED strip 30. The end module 130 is also designed to accept any excess LED strip 30, thereby allowing for the visible portion of the LED strip 30 to be in any length, not just the length set by the LED strip 30 itself. The end modules 130 allow for the flangeless installation of the apparatus 100 on the edges of the channel 110.

Figure 4:
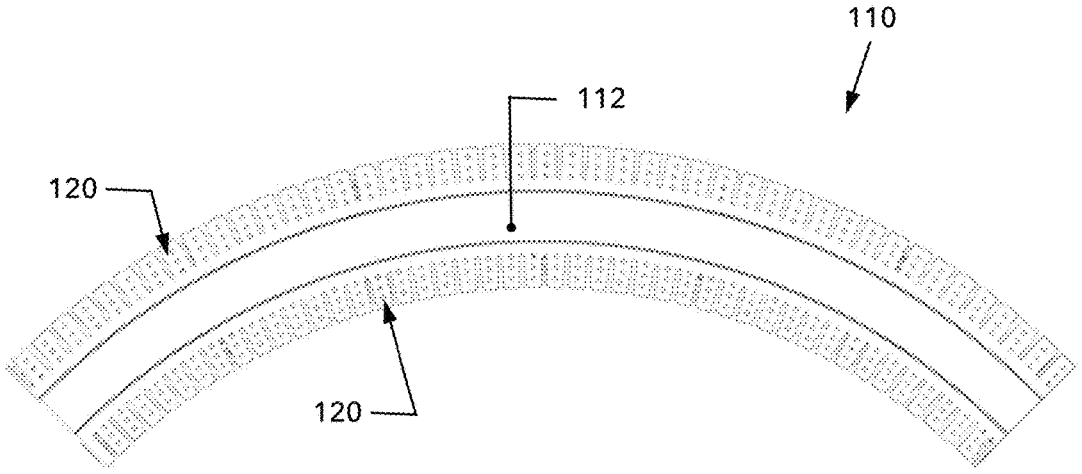
FIG. 4 is a top view of an embodiment of the support device of FIG. 2.
Figure 5:
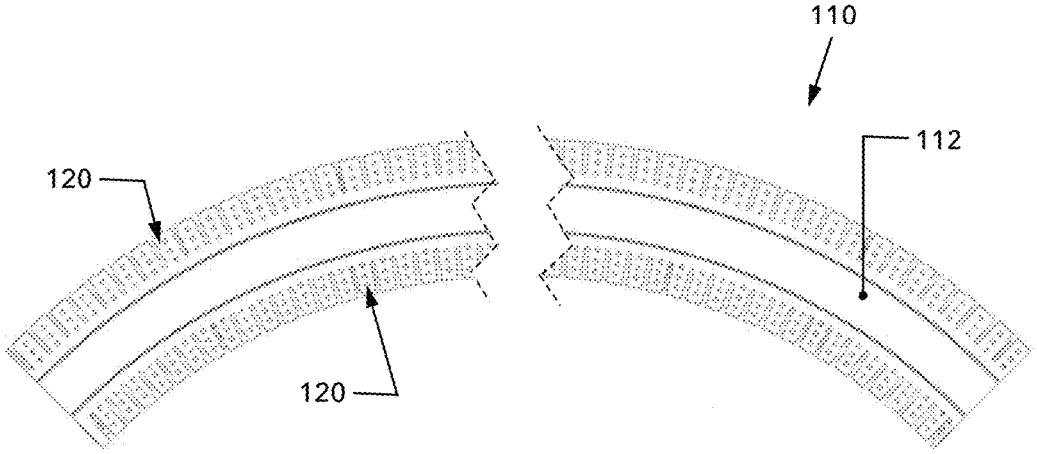
FIG. 5 is a top view of the support device of FIG. 2, with the jagged lines indicating elongation thereof in conformity with the length of LED strip lighting used therewith.

The channel 110 may be bent using common bending methods to meet the curvature required for a particular installation. The flanges 120 may be notched, as illustrated in FIGS. 4 and 5, allowing them to flex without buckling to fit the curvature of the channel 110. The lens 102 is made of material (such as silicone or similar material) that can bend to accommodate the curvature of the aluminum extrusion of the main channel 110. Alternatively, the flanges 120, the lens 102, or both may be preformed with a curvature that corresponds to the curvature of the channel 110.

Figure 3:
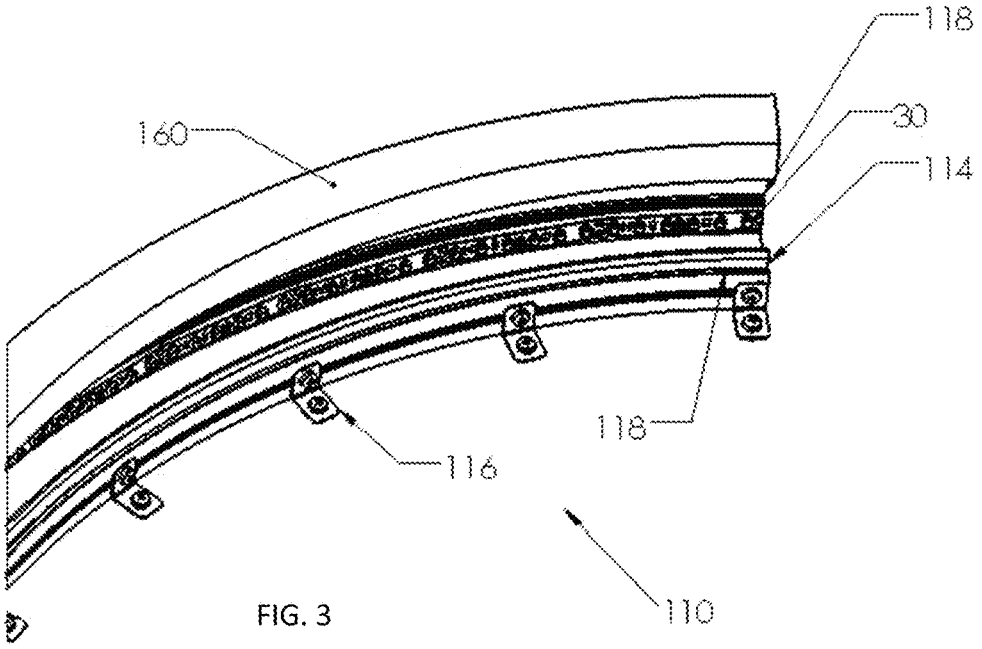
FIG. 3 is a top perspective view of the support device of FIG. 2, with an LED lighting strip positioned thereon.
Figure 6:
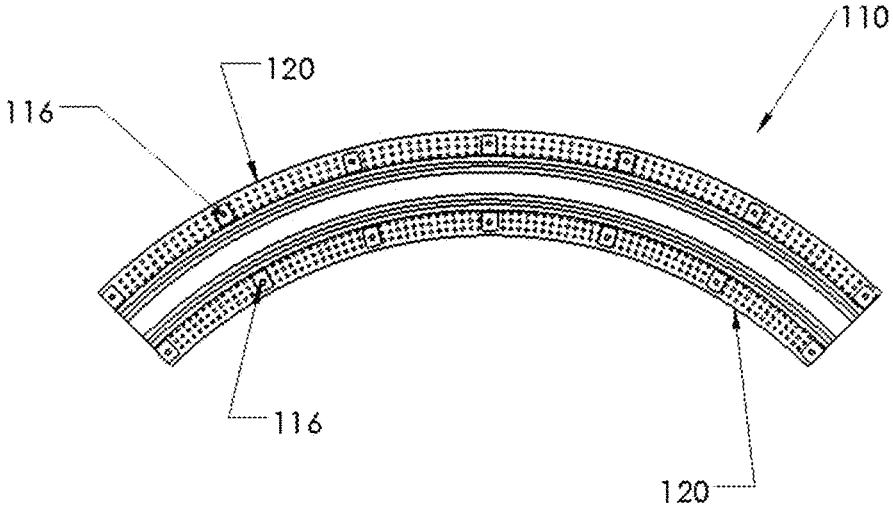
FIG. 6 is a bottom view of the support device of FIG. 2.
Figure 7:
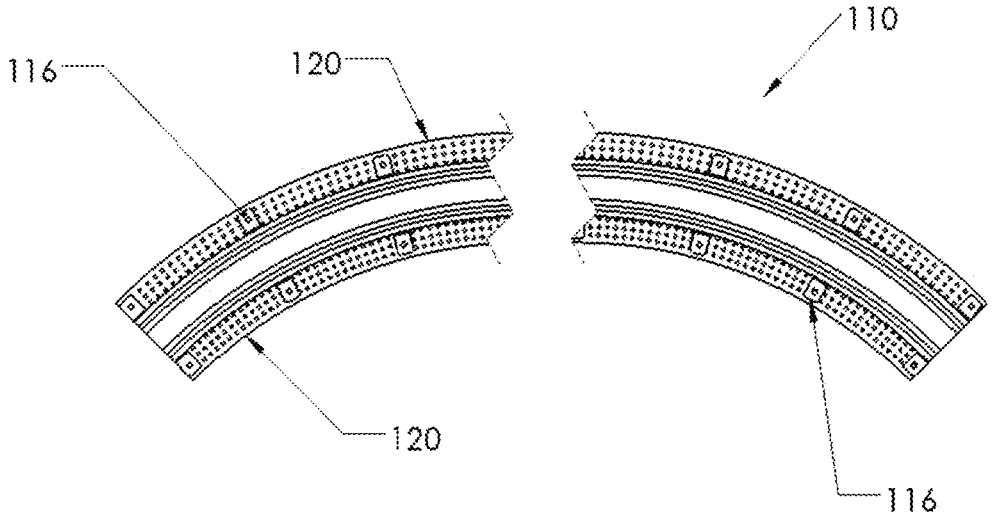
FIG. 7 is a bottom view of the support device of FIG. 7, with the jagged lines indicating elongation thereof in conformity with the length of LED strip lighting used therewith.
Figure 8:
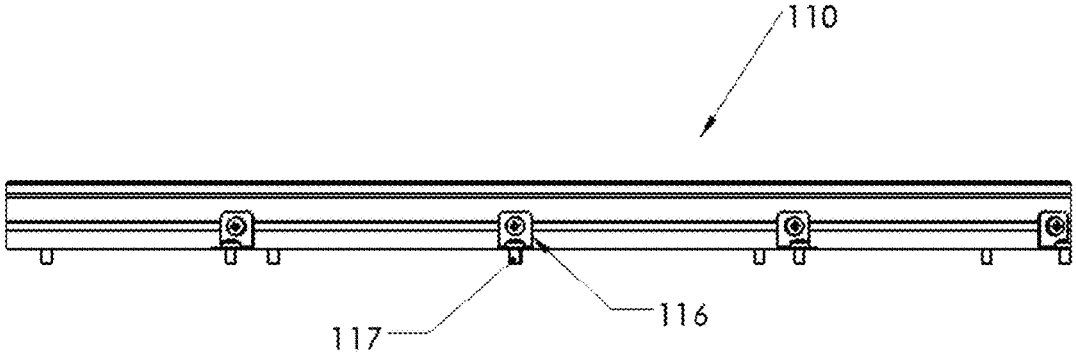
FIG. 8 is a side view of the support device of FIG. 2.

FIG. 2 is an exploded view of an embodiment of the installation support 100 of the present invention. Specifically, the device 100 includes an elongated open-top main channel section 110 and one or two elongated open-top end modules 130. The main channel section 110 includes a bottom 112, from which a pair of spaced apart sidewalls 114 extend perpendicularly upwards, and to which a pair of bottom clips 116 attach by means of screws 117 outward beyond the sidewalls 114 (see also FIG. 3). The bottom 112 and sidewalls 114 are preferably formed as a single unit, as illustrated in the end cross-sectional view of FIG. 9A, and preferably formed from aluminum. Grooves 118 (see FIG. 3) in the top edges of the sidewalls 114 are configured to receive the top flanges 120, preferably formed from PVC or other like material, as will be described below. When the top flanges 120 are inserted into the grooves 118, the distance between their outer edges is approximately equal to the distance between the outer edges of the bottom clips 116 (see also FIG. 9A). FIG. 4 is a top view of the main channel section 110 with the top flanges 120 installed while FIG. 5 is a similar view with the jagged lines indicating that the main channel section 110 is not limited to any particular arc length and diameter but may be formed in any desirable length and diameter range to accommodate the desirable length of an LED strip light 30. Upper and lower limits are not being included herein so as to not restrict the scope of the present invention. FIGS. 6 and 7 are bottom views of the main channel section 110, corresponding to FIGS. 4 and 5, respectively. FIG. 8 is a side view of the main channel section 110 while FIG. 9A, as noted above, is an end cross-sectional view of the main channel section 110 with the lens 102 installed.

Figures 9A, 9B:
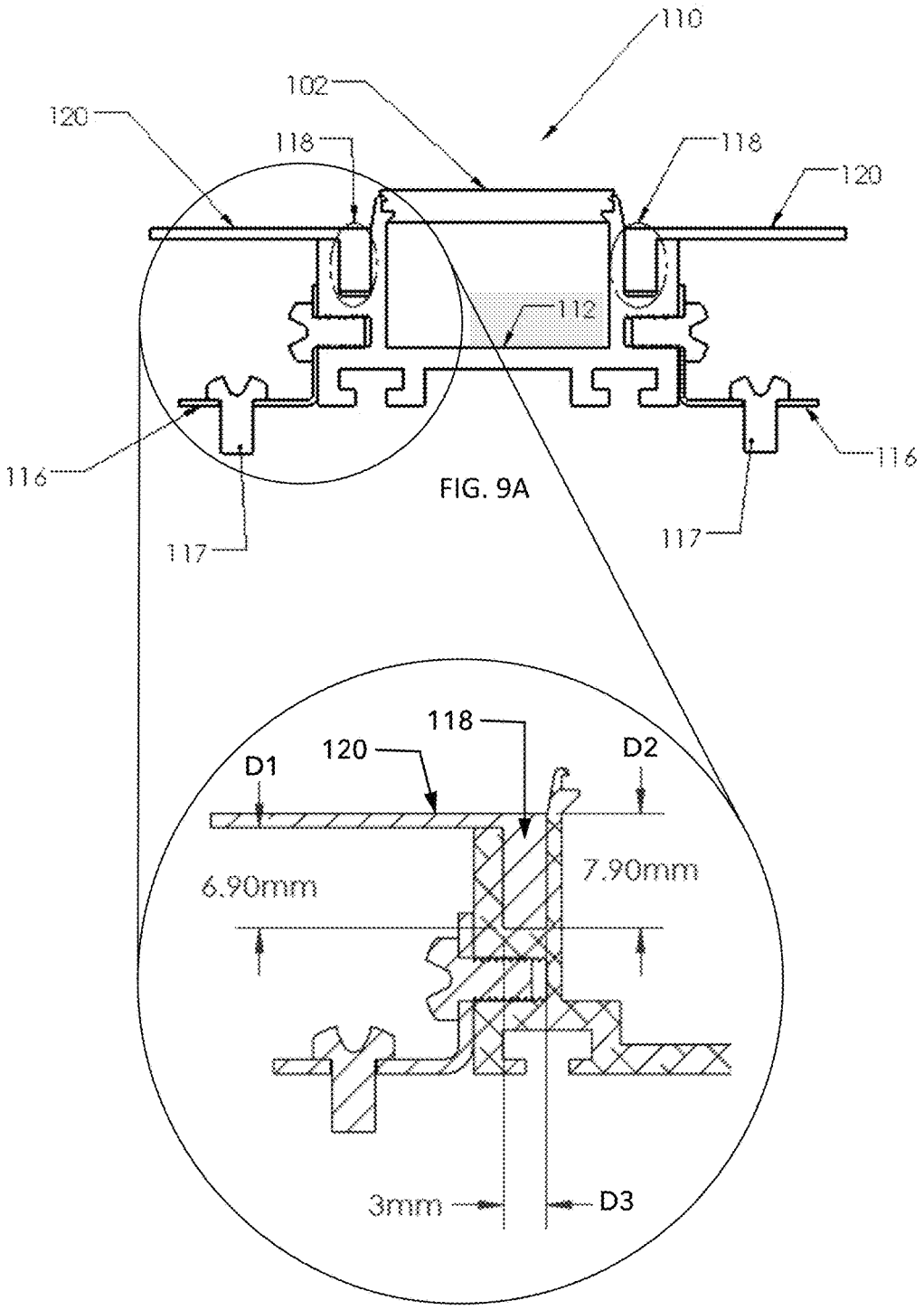
FIG. 9A is a cross-sectional view of the support device of FIG. 2.
FIG. 9B is an enlarged portion of the cross-sectional view of FIG. 9A.

FIG. 9B is an enlarged view of the cross-sectional view of FIG. 9A and denotes three dimensions of one embodiment of the main channel section 110, which allow the surface of the lens 102 to be substantially flush with the surface of the spackle 42 over the drywall 40. For example, in the embodiment illustrated, to be flush with standard, spackle-coated ⅝ inch drywall, the vertical distance D1 between the bottom of the flange 120 and the bottom of the groove 118 is 6.90 mm; the distance D2 between the top and bottom of the groove 118 is 7.90 mm; and, the width D3 of the groove 118 is 3 mm. It will be appreciated that these dimensions are merely representative of one embodiment and are not meant to be limiting.

Figure 15:
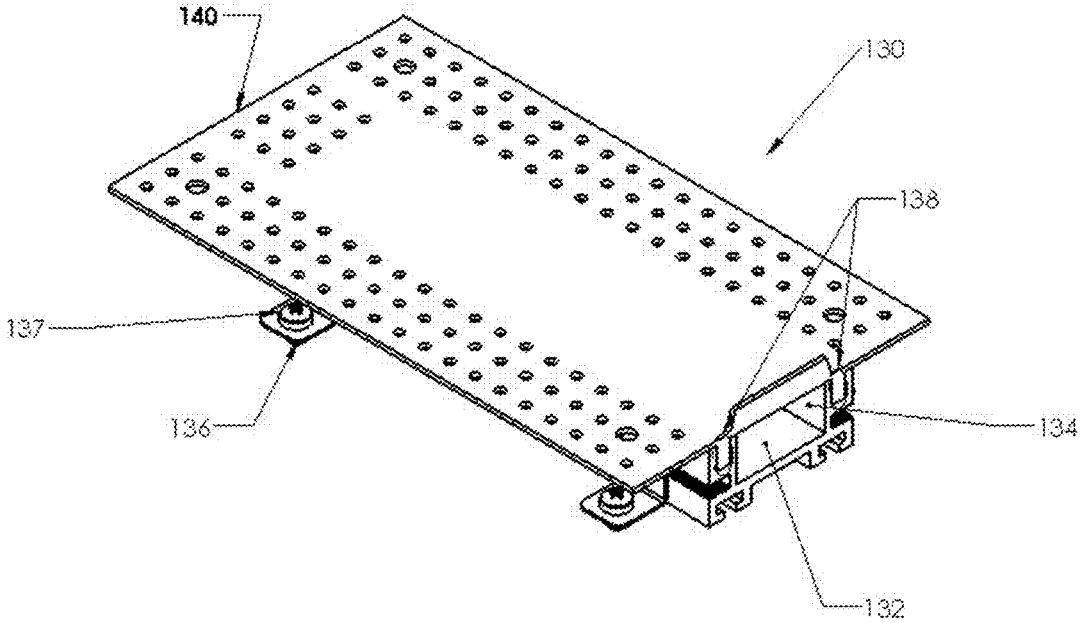
FIG. 15 is a right side perspective view of the end module of FIG. 10.

The end modules 130 are of similar design, though shorter in length. Specifically, each end module 130 includes a bottom 132 (FIG. 12), from which a pair of spaced apart sidewalls 134 (FIG. 15) extend perpendicularly upwards, and a pair of bottom clips 136 attached by means of screws 137 extending outward parallel to the bottom 132 beyond the sidewalls 134. The bottom 132 and sidewalls 134 are preferably formed as a single unit. Grooves 138 (FIG. 15) in the sidewalls 134 are configured to receive spaced apart flanges extending perpendicularly from the bottom surface of a planar top channel cap 140, as illustrated in FIG. 15 and as will be described below. When the flanges in channel cap 140 are inserted into the grooves 138, the distance between their outer edges is about equal to the distance between the outer edges of the bottom clips 136. An end cap 142 (FIG. 13) closes the outer end of the end module 130.

Figure 10:
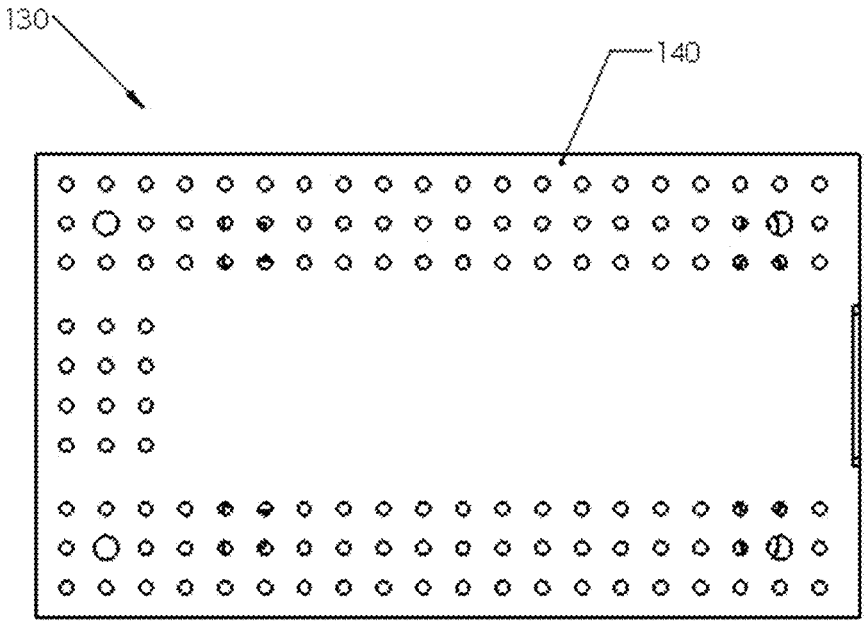
FIG. 10 is a top view of an end module for the LED strip support device of FIG. 2.
Figure 11:
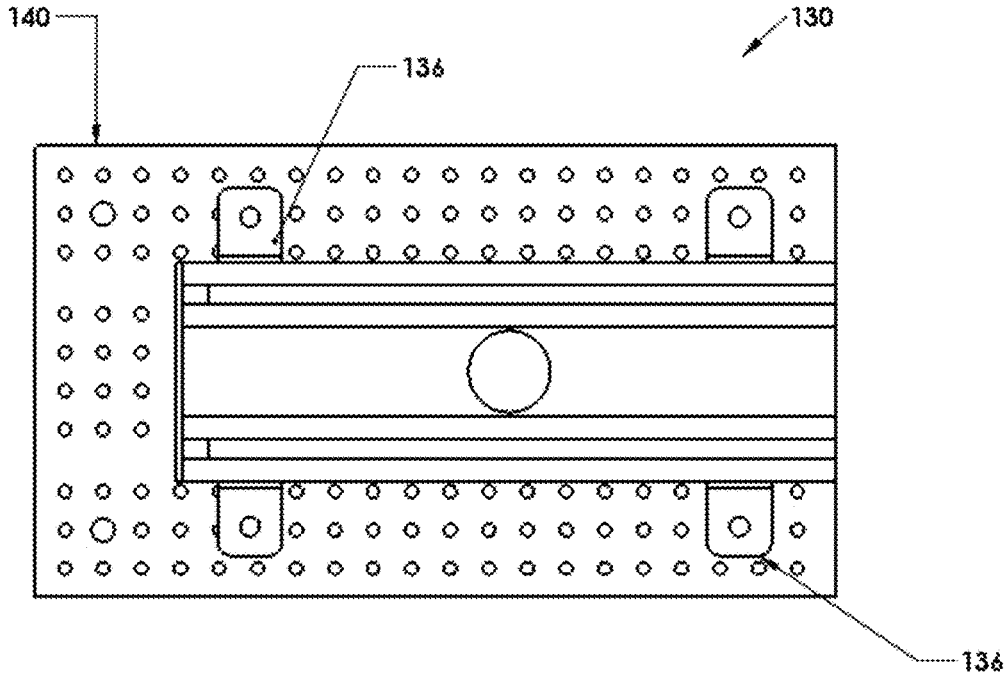
FIG. 11 is a bottom view of the end module of FIG. 10.
Figure 12:
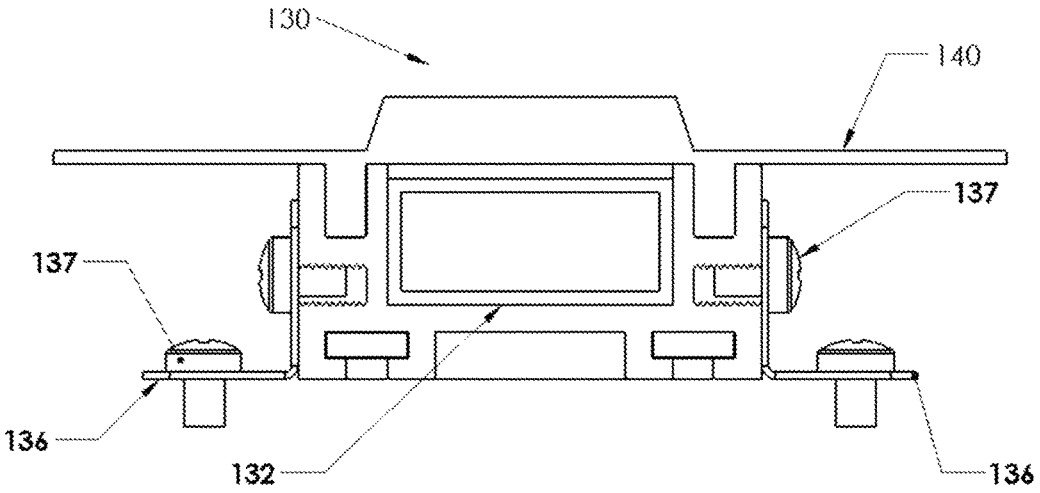
FIG. 12 is a view of one end of the end module of FIG. 10.
Figure 13:
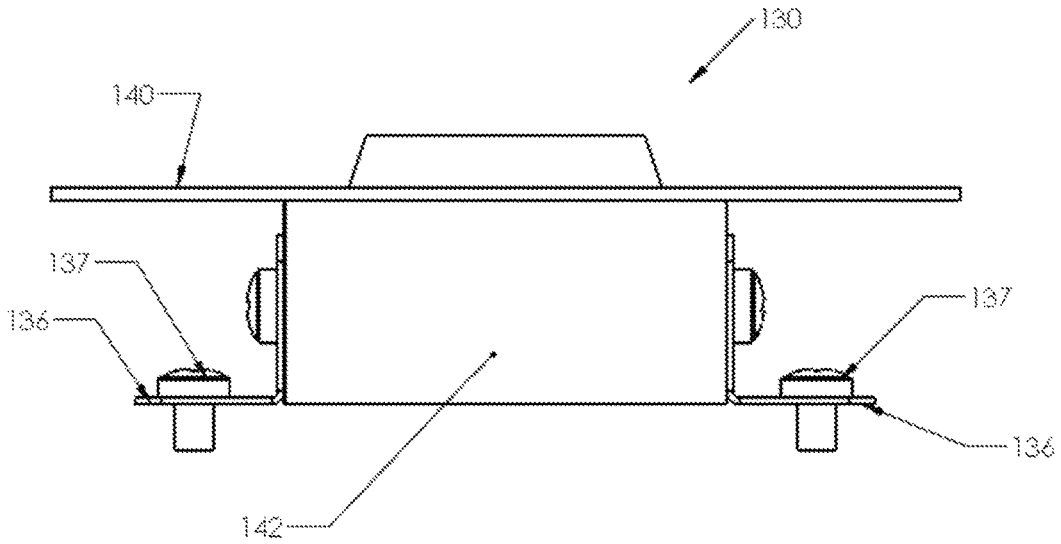
FIG. 13 is a view of the opposite end of the end module of FIG. 10.
Figure 14:
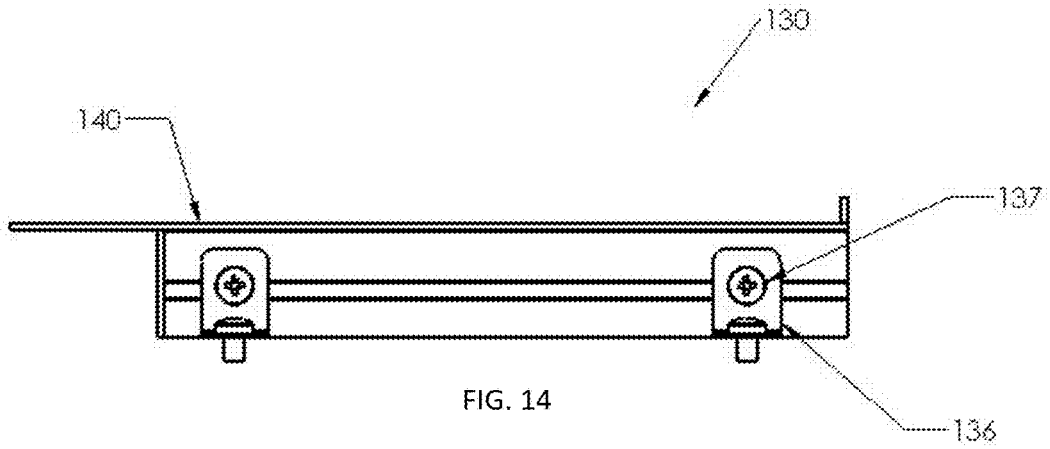
FIG. 14 is a side view of the end module of FIG. 10, with the rear view being a mirror image thereof.

FIG. 10 is a top view of the end module 130 with the channel cap 140 installed FIG. 11 is a bottom view of the end module 130. FIG. 12 is a cross-sectional view of one end of the end module 130 with the channel cap 140 and end cap 142 installed while FIG. 13 is an cross-sectional view of the other end of the end module 130. FIG. 14 is a side view of the end module 130 and FIG. 15 is a perspective view of the assembled end module 130.

Referring back to FIG. 2, the end module 130 is secured to the main channel section 110 with a pair of connectors 150.

To install the support device 100, an installer, such as an electrician, first takes the main channel section 110, positions it at the desired location after the structure has been framed in and before drywall has been installed. The installer screws the bottom clips 116 to the main channel section 110 and then into the wall studs or ceiling joists and connects attaches the end modules 130 to the main channel section 110 using the T-shape connectors 150. The installer wires the device using by feeding a BX or other cable through an attached connector into one of the end modules 130. The installer then lays the LED strips 30 onto both the sidewalls 114 following the curvature of the main channel section 110, lays any extra LED strip 30 in the end module 130, and secures the channel cap 140 in the grooves 138 (FIG. 15) and the end cap 142 on the end of the end module 130. The other end of the cable may be electrically connected to an LED driver mounted in any convenient location, such as in an access panel or closet.

The painter/spackler then inserts foam 160 (FIG. 3) inside the space between the sidewalls 114 of the main channel section 110 to protect the inside of the main channel section 110 and the LED strip 30. The painter/spackler inserts the top flanges 120 into the grooves 118 in sidewalls 114 of the main channel section 110. The painter/spackler may then lay drywall 40 up to the edges of the device 100, screw the flanges 120 and channel cap 140 into the drywall, and spackle 42 up to the edge of the main channel section 110 and end modules 130. Spackle 42 is then reapplied, as per typical spackle installation, and the drywall 40 with spackle 42 is painted. Once finished, the foam 160 is removed from inside the main channel section 110 and the lens 102 is secured onto the main channel section 110. The installation is completed and the result is a line of light which is flangeless, flush, and which can be installed to almost any desirable arc length and diameter.

In contrast with conventional systems in which aluminum with a thermal conductivity of about 237 W/(m·K) (watts per meter-Kelvin) is used as the front flange 120, the front flange 120 of the system 100 of the present invention may be formed from PVC, which allows the front flange 120 to remain cool, thereby reducing the risk of the paint and spackle cracking from heat changes.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A curved recessed supporting device for installation of LED illuminating devices, comprising:

an elongated curved main channel section, comprising:

a first bottom;

first and second spaced apart sidewalls, each extending perpendicularly from opposite sides of the first bottom and each having a groove in a top edge;

at least one pair of first bottom clips extending outward from the first bottom beyond the first and second sidewalls; and first and second top flanges, each having a curve equal to the curve of the main channel section, the first top flange insertable into the groove of the first sidewall and extending perpendicularly outward from the first sidewall, and the second top flange insertable into the groove of the second sidewall and extending perpendicularly outward from the second sidewall, whereby when the first and second top flanges are inserted in the grooves of the first and second sidewalls, a distance between outer edges of the first and second top flanges is substantially equal to a distance between outer edges of the first pair of bottom clips;

a first elongated open-top end module, shorter than the main channel section and securable at a first end to a first end of the main channel section, the first end module comprising:

a second bottom;

third and fourth spaced apart sidewalls, each extending perpendicularly from opposite sides of the second bottom and each having a groove in a top edge;

at least one second pair of bottom clips extending outward from the second bottom beyond the third and fourth sidewalls; and a planar top cap having a width substantially equal to a distance between outer edges of the second pair of bottom clips, the top cap further having a third pair of spaced apart flanges extending perpendicularly from a bottom surface of the top cap, the third pair of flanges being insertable into the grooves in the top edges of the third and fourth sidewalls; and an elongated lens securable between the first and second sidewalls of the main channel section.

2. The curved recessed supporting device of claim 1, further comprising a second elongated open-top end module securable to a second end of the main channel section.

3. The curved recessed supporting device of claim 1, wherein the main channel section is formed from aluminum.

4. The curved recessed supporting device of claim 1, wherein the main channel section is formed as a single piece.

5. The curved recessed supporting device of claim 1, wherein the top flanges are formed from polyvinyl chloride (PVC).

6. The curved recessed supporting device of claim 1, wherein the lens is formed from a flexible material.

7. The curved recessed supporting device of claim 1, further comprising a pair of T-shaped connectors securable between the first end module and the first end of the main channel section.

8. The curved recessed supporting device of claim 1, wherein the first end module further comprises an end cap securable to a second end of the first end module.

9. The method of claim 1, further comprising securing the first end module with the first end of the main channel section with a pair of T-shaped connectors.

10. A method of installing curved LED illuminating devices, comprising:

placing an elongated curved main channel section against a wall stud or ceiling joist, the main channel section having a first bottom and first and second spaced apart sidewalls extending perpendicularly from opposite sides of the first bottom;

securing first bottom clips between the main channel section and the wall stud or ceiling joist, the first bottom clips extending outward from a bottom of the main channel section perpendicular to the first and second sidewalls;

securing first and second top flanges to top edges of the first and second sidewalls, respectively, the first and second top flanges extending outward perpendicular to the first and second sidewalls;

securing a first end of a first end module to a first end of the main channel section, the first end module having a second bottom and third and fourth spaced apart sidewalls;

securing second bottom clips to the wall stud or ceiling joist, the second bottom clips extending outward from the second bottom of the first end module;

securing LED strips to the insides of the first and second spaced apart sidewalls of the main channel section;

extending an electric cable through the first end module;

connecting the electric cable to an end of the LED strip;

securing a channel cap across top edges of the third and fourth sidewalls of the first end module, the channel cap extending beyond the third and fourth sidewalls;

temporarily inserting foam into space in the main channel section between the first and second sidewalls;

laying drywall to edges of the main channel section and the first end module;

painting and spackling the drywall;

removing the foam from the main channel section; and securing a lens over the main channel section between the first and second sidewalls.

11. The method of claim 10, further comprising securing an end cap to a second end of the first end module.

12. The method of claim 10, further comprising securing a first end of a second end module to a second end of the main channel section after securing the first end module to the first end of the main channel section.

13. The method of claim 10, further comprising, after securing the LED strips to the sides of the main channel section, placing any extra length of the LED strip in the first end module.

14. The method of claim 10, further comprising, before securing the first and second top flanges to the sidewalls, bending the first and second top flanges to a curvature corresponding to a curvature of the main channel section.

15. The method of claim 10, further comprising, before securing the lens over the main channel section, bending lens to a curvature corresponding to a curvature of the main channel section.

16. The method of claim 10, further comprising, after securing the LED strips to the insides of the first and second sidewalls, placing in the first end module lengths of the LED strips longer than a length of the main channel section.

17. The method of claim 10, further comprising securing an end cap to a second end of the first end module.

* * * * *